United States Patent [19]

Demarest, Jr.

[11] Patent Number: 4,738,007

[45] Date of Patent: Apr. 19, 1988

[54] CLIP FOR STACKED SHEETS

[76] Inventor: Russell G. Demarest, Jr., 60 Forest Rd., Glen Rock, N.J. 07452

[21] Appl. No.: 68,537

[22] Filed: Jul. 1, 1987

[51] Int. Cl.[4] ..... B42F 1/02

[52] U.S. Cl. ..... 24/67.9; 24/546; 24/563

[58] Field of Search ..... 24/67.9, 67.3, 67 R, 24/545, 546, 543, 563; 206/53

[56] References Cited

U.S. PATENT DOCUMENTS

| | | | |
|---|---|---|---|
| 430,331 | 6/1890 | Ballard | 24/67 R |
| 1,156,396 | 10/1915 | Denio | 206/53 |
| 1,310,587 | 7/1919 | Sumersille | 24/67.9 |
| 1,675,286 | 6/1928 | Van Valkenburg | 24/563 |
| 1,828,417 | 10/1931 | Keleher | 24/67.3 |
| 2,838,817 | 6/1958 | Wills | 24/67.9 |
| 2,910,749 | 11/1959 | Parker | 24/67.9 |
| 2,985,290 | 5/1961 | Locklin | 24/546 |
| 3,105,278 | 10/1963 | Sponsel | 24/67.9 |
| 3,172,181 | 3/1965 | Fawick | 24/546 |
| 3,572,428 | 3/1971 | Monaco | 24/546 |

*Primary Examiner*—Victor N. Sakran

*Attorney, Agent, or Firm*—Samuelson & Jacob

[57] ABSTRACT

A clip for securing together a stack of sheets, the stack having a height, or thickness, which can vary over an extended range, the clip having opposed clamping legs spaced apart and extending parallel to one another, a web interconnecting the clamping legs at corresponding ends of the clamping legs, and resiliently deflectable undulations in the web allowing relative displacement of the clamping legs away from one another to receive the stack between the clamping legs and biasing the clamping legs toward one another with a biasing force sufficient to secure the stack, while the clamping legs remain parallel to one another.

16 Claims, 1 Drawing Sheet

CLIP FOR STACKED SHEETS

The present invention relates generally to clips and pertains, more specially, to clips which secure together a stack of sheets, wherein the stack may vary in height, or thickness, over an extended range.

The art of clips, and especially paper clips, is highly developed. The quest for versatility combined with economical manufacture has led to a wide variety of configurations, all aimed at securing together a plurality of sheets of paper and the like with a simple, inexpensive, often expendable, device. The most commonly used clips usually are supplied in several sizes for use with stacked sheets of various heights, or thickness, each size being effective over only a limited range of stack height. Attempts have been made at extending the range of effective operation of such clips. For example, it has been suggested that a clip having opposed clamping arms connected by a coil spring arrangement will have an extended effective range by virtue of the resilient expansion and contraction of the coiled structure. However, the coiled structure is rather bulky and has the tendency to become entangled with the stack as individual sheets of the stack slip between the coils. Other clips have been constructed to accommodate a wide range of stack heights, but do so with clamping members which are angled relative to the sheets in the stack, the angles changing with each variation in stack height.

The present invention provides a clip construction which attains several objects and advantages, some of which may be summarized as: An expensive one-piece construction enabling effective securing of sheets within a stack which may vary in thickness, or height, over an extended range; a construction providing opposed clamping legs which remain essentially parallel, in effective clamping engagement with the stack, over an extended range of stack thickness, or height; ease of use, from the standpoint of both application to and removal from a stack of any height within the given range of operation of the clip; and effective operation throughout many re-uses with stacks of varying size.

The above objects and advantages are attained by the present invention, which may be described briefly as a clip for securing together a stack of sheets, the stack having a height which can be varied over a given extended range, the clip comprising: a first clamping leg extending longitudinally between opposite ends; a second clamping leg spaced altitudinally from the first clamping leg and extending longitudinally between opposite ends, generally parallel to the first clamping leg; and a connecting web extending altitudinally between the first and second clamping legs and including a plurality of laterally-extending undulations resiliently deflectable in altitudinal directions to accommodate a stack of selected height within the given range while maintaining the first and second clamping legs essentially parallel and biased toward one another with a sufficient securing force throughout the extended range.

The invention will be understood more fully, while still further objects and advantages will become apparent, in the following detailed description of a preferred embodiment of the invention illustrated in the accompanying drawing, in which.

Figure 1:
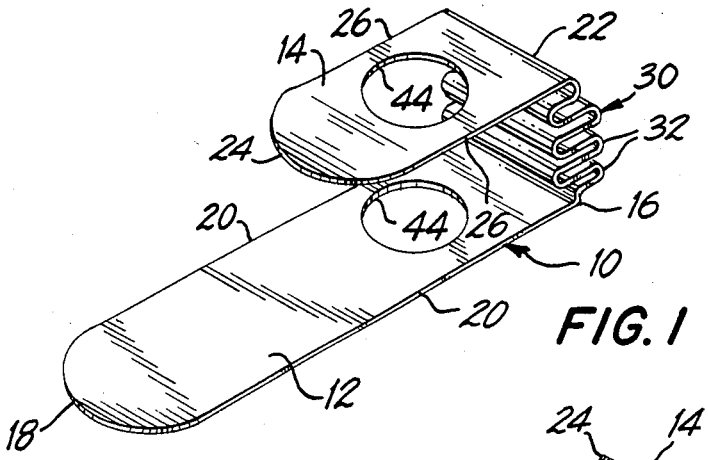
FIG. 1 is a perspective view of a clip constructed in accordance with the invention.

Referring now to the drawing, and especially to FIG. 1 thereof, a clip constructed in accordance with the invention is illustrated at 10 and is seen to include opposed first and second clamping legs 12 and 14, respectively. First clamping leg 12 extends longitudinally between opposite ends 16 and 18 and has laterally spaced apart edges 20. Second clamping leg 14 extends longitudinally between opposite ends 22 and 24 and has laterally spaced apart edges 26. Clamping legs 12 and 14 extend generally parallel to one another.

A web 30 interconnects the clamping legs 12 and 14 and extends in a altitudinal direction between the clamping legs 12 and 14 from end 16 of clamping leg 12 to end 22 of clamping leg 14. Ordinarily, the first clamping leg 12 is placed below the second clamping leg 14, as shown, and serves as a base. Preferably, the basal first clamping leg 12 has a length between end 16 and free end 18 which is twice the length of second clamping leg 14, between end 22 and free end 24. Thus, clip 10 has a generally J-shaped edge configuration.

Figure 2:
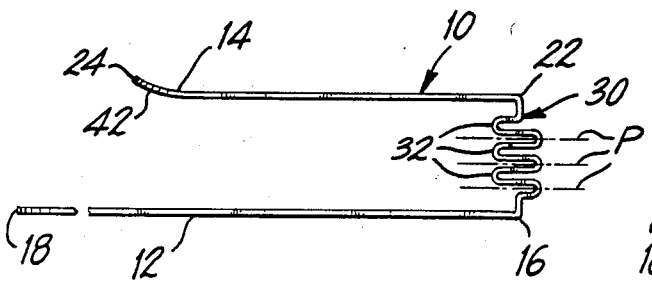
FIG. 2 is an enlarged elevational edge view of the clip, with the clip contracted.
Figure 3:
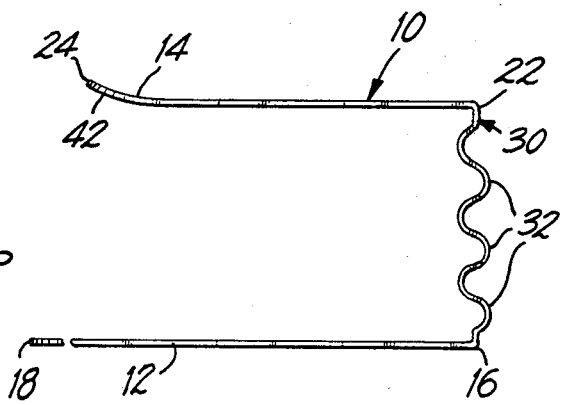
FIG. 3 is an enlarged elevational edge view of the clip, with the clip expanded.

In order to enable relative movement of the first and second clamping legs 12 and 14 toward and away from one another, while preserving the essentially parallel relationship between the clamping legs 12 and 14, web 30 is provided with a plurality of laterally extending, resiliently deflectable undulations 32. In clip 10, the clamping legs 12 and 14, web 30 and undulations 32 all are unitary and are constructed of a strip of spring steel, with undulations 32 normally biasing the clamping legs 12 and 14 toward one another into the position shown in FIG. 2, and enabling expansion of the clip 10 by movement of the clamping legs 12 and 14 away from one another, toward the position shown in FIG. 3, for purposes which will be described below. Suffice it to say that undulations 32 are provided in sufficient number and are of a longitudinal extent great enough to accommodate relatively large altitudinal displacements of the clamping legs 12 and 14 away from one another while assuring that the deflection in each undulation 32 is essentially within the elastic range so that the clamping legs 12 and 14 always will be biased toward the position shown in FIG. 2. Undulations 32 preferably are parallel to one another and lie in planes P parallel to the clamping legs 12 and 14. As illustrated, clip 10 is constructed of a single sheet of spring material, in the form of a laterally flat ribbon.

Figure 4:
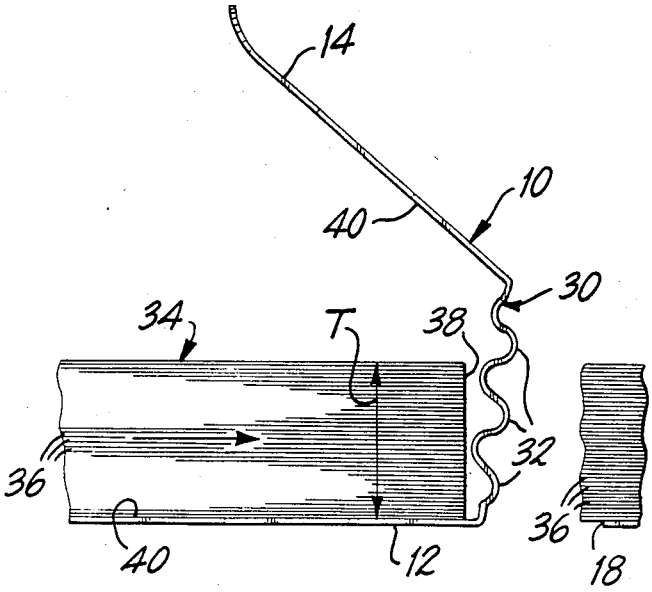
FIG. 4 is an elevational view similar to FIG. 2, with the clip being opened to admit a stack to be secured.
Figure 5:
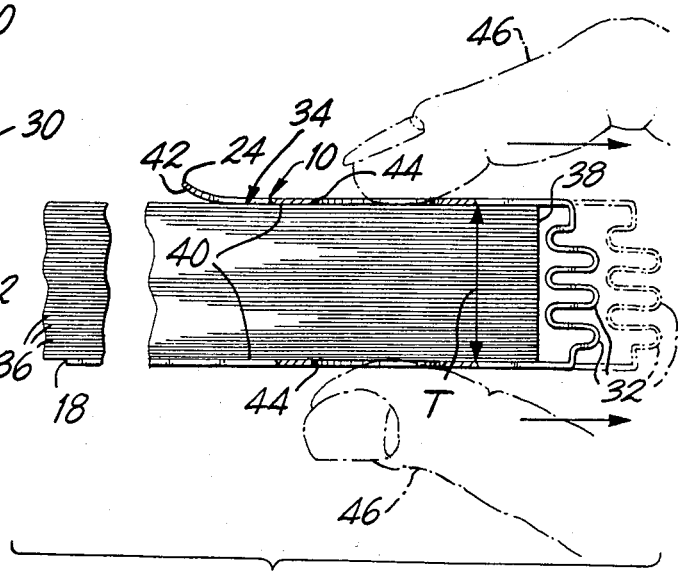
FIG. 5 is an elevational edge view similar to FIG. 3, with a stack secured within the clip.

As seen in FIGS. 4 and 5, a stack 34 of sheets 36 having a thickness (or height) T is to be placed within clip 10 so that the clip 10 will secure sheets 36 within stack 34. Preferably, second clamping leg 14 is lifted and rotated slightly, as shown in FIG. 4, undulations 32 being flexed to permit the relative movement between the clamping legs 12 and 14. The edge 38 of stack 34 then is inserted into clip 10, between clamping legs 12 and 14, and clamping leg 14 is released. Clamping leg 14 will be biased toward clamping leg 12, by the biasing force of undulations 32, into the position shown in FIG. 5. In that latter position, clamping leg 14 is parallel to clamping leg 12 and the clamping legs 12 and 14 grip securely the sheets 36 of stack 34 adjacent edge 38 of the stack 34. The parallel relationship of the clamping legs 12 and 14 assures that the opposed clamping surfaces 40 of the clamping legs 12 and 14 will be fully engaged with the stack 34 for maximum effective securement of the sheets 36 within the stack 34 and of the clip 10 upon the stack 34. Alternately, clip 10 may be slipped over the edge 38 of stack 34 without rotation of the upper clamping leg 14. In order to facilitate such a procedure, the free end 24 of clamping leg 14 may be provided with a flared portion 42, flared outwardly relative to clamping leg 12. In a similar manner, free end 18 of clamping leg 12 may be provided with a small flared portion to preclude any snagging of the lowermost sheet 36 in stack 34 upon insertion of the edge 38 of stack 34 into clip 10.

Removal of clip 10 from stack 34 is accomplished by gripping the clamping legs 12 and 14 and merely pulling the clip 10 longitudinally away from the edge 38 of stack 34, as illustrated in phantom in FIG. 5. Gripping of the clamping legs 12 and 14 is facilitated by the provision of thumb and finger grips shown in the form of thumb and finger apertures 44 (also see FIG. 1) in the clamping legs 12 and 14, as indicated by the thumb and fingers illustrated in phantom at 46.

It will be seen that the employment of an undulated web 30 interconnecting essentially parallel clamping legs 12 and 14 maintains the clamping legs 12 and 14 essentially parallel throughout an extended range of variation in the thickness T of a stack 34 which can be accommodated by a clip 10 of a single size. The use of multiple undulations 32 assures that the biasing force provided by the undulations will not become excessive as the thickness of the stack 34 is made greater since the total displacement between the clamping legs 12 and 14 is distributed throughout all of the undulations 32, requiring only a relatively small deflection in each individual undulation 32 to attain a relatively large displacement between the clamping legs 12 and 14. The construction enables ease of use and assures reliable operation through many re-uses for a long service life.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A clip for securing together a stack of sheets, the stack having a height which can be varied over a given extended altitudinal range, the clip comprising:

a first clamping leg extending longitudinally between opposite ends;

a second clamping leg spaced altitudinally from the first clamping leg and extending longitudinally between opposite ends, generally parallel to the first clamping leg; and a connecting web extending altitudinally between the first and second clamping legs and interconnected with each of the first and second clamping legs at interconnections adjacent the corresponding ends of the first and second clamping legs, the connecting web including a plurality of laterally-extending undulations resiliently expandable and contractible in altitudinal directions to enable resilient expansion and contraction of the connecting web in altitudinal directions, and concomitant altitudinal displacement of the first and second clamping legs relative to one another, while biasing the connecting web toward contraction so as to accommodate a stack of selected height within the given range, said relative altitudinal displacement of the first and second clamping legs being effected without deflection of the first and second clamping legs relative to the connecting web, at the interconnection between the connecting web and each clamping leg, so as to maintain the first and second clamping legs essentially parallel to one another and biased toward one another with a sufficient securing force arising out of biasing the connecting web toward contraction, throughout the extended range.

2. The invention of claim 1 wherein the undulations are essentially parallel to one another.

3. The invention of claim 1 wherein the undulations lie in planes essentially parallel to one another and essentially parallel to the first and second clamping legs.

4. The invention of claim 1 wherein the web interconnects the first and second clamping legs at the corresponding ends of the clamping legs, the opposite ends being free.

5. The invention of claim 4 wherein at least the second clamping leg includes a portion flared outwardly away from the first clamping leg adjacent the free end of the second clamping leg.

6. The invention of claim 5 wherein the first clamping leg has a longitudinal length approximately twice the longitudinal length of the second clamping leg.

7. The invention of claim 1 including thumb and finger grips on the clamping legs.

8. The invention of claim 7 wherein the thumb and finger grips include an aperture in each clamping leg.

9. The invention of claim 1 wherein the clamping legs, web and undulations are unitary and are constructed of a spring material.

10. The invention of claim 9 wherein the spring material is in the form of a laterally flat ribbon.

11. The invention of claim 10 wherein the undulations lie in planes essentially parallel to one another and essentially parallel to the first and second clamping legs.

12. The invention of claim 10 wherein the web interconnects the first and second clamping legs at the corresponding ends of the clamping legs, the opposite ends being free.

13. The invention of claim 12 wherein at least the second clamping leg includes a porton flared outwardly away from the first clamping leg adjacent the free end of the second clamping leg.

14. The invention of claim 13 wherein the first clamping leg has a longitudinal length approximately twice the longitudinal length of the second clamping leg.

15. The invention of claim 14 including thumb and finger grips on the clamping legs.

16. The invention of claim 15 wherein the thumb and finger grips include an aperture in each clamping leg.

* * * * *

UNITED STATES PATENT AND TRADEMARK OFFICE

CERTIFICATE OF CORRECTION

PATENT NO. : 4,738,007

DATED : April 19, 1988

INVENTOR(S) : Russell G. Demarest, Jr.

It is certified that error appears in the above—identified patent and that said Letters Patent is hereby corrected as shown below:

Column 1, line 33, "expensive" should read -- inexpensive --

Signed and Sealed this

Twentieth Day of September, 1988

*Attest:*

DONALD J. QUIGG

*Attesting Officer*

*Commissioner of Patents and Trademarks*